US005355787A

United States Patent [19]

Burns et al.

[11] Patent Number: 5,355,787

[45] Date of Patent: Oct. 18, 1994

[54] TAPING MACHINE FOR WIRE HARNESS

[76] Inventors: Arthur G. Burns, 49 Fallowfield, Orton Wistow, Peterborough PE2 OUR; Ken Aubrey, 34 Bradwell Road, Long-thorpe, Peterborough, Cambridgeshire; David Hyland, 37 Wainbody Avenue, Coventry, Warwickshire, all of United Kingdom; Andres Marin Correa; Manuel Fernandez Martin, both of Passeig de l'estacio 14, Valls, Tarragona, Spain

[21] Appl. No.: 972,443

[22] PCT Filed: Jul. 31, 1991

[86] PCT No.: PCT/GB91/01299

§ 371 Date: Jan. 29, 1993

§ 102(e) Date: Jan. 29, 1993

[87] PCT Pub. No.: WO92/02417

PCT Pub. Date: Feb. 20, 1992

[30] Foreign Application Priority Data

Jul. 31, 1990 [ES] Spain ..... P9002280

[51] Int. Cl.[5] ..... B65B 13/10

[52] U.S. Cl. ..... 100/27; 100/33 PB; 156/486

[58] Field of Search ..... 100/13, 27, 28, 33 PB; 156/392, 425, 428, 468, 486, 579

[56] References Cited

U.S. PATENT DOCUMENTS

| | | | |
|---|---|---|---|
| 3,031,368 | 4/1962 | Zent | 156/486 |
| 3,245,860 | 4/1966 | Aurich et al. | 156/486 |
| 3,414,451 | 12/1968 | Sejda | 156/468 X |
| 4,204,905 | 5/1980 | Miyamoto | 156/468 X |
| 4,602,976 | 7/1986 | Fukuda et al. | 156/468 X |
| 4,790,896 | 12/1988 | Schmalholtz | 100/27 X |
| 4,871,414 | 10/1989 | Niedrig | 100/33 PB X |
| 4,961,815 | 10/1990 | Buckley et al. | 156/486 X |

*Primary Examiner*—Stephen F. Gerrity
*Attorney, Agent, or Firm*—William W. Habelt

[57] ABSTRACT

Taping apparatus (27) has a body (3) with a mouth (3*a*) opening to one side radially of an axis (A). A head (1, 5, 16) having a mouth (3*a*) radial of the axis (A) is mounted for rotation about the axis (A) on the body (3) and has a gear disposed around the head in meshing engagement with two gears (17) mounted on the body. The gears (17) are both in mesh with a gear (9) rotated by a gear (11) driven by motor (12) thus to rotate the head. A tape reel (28) is carried by chuck (6) rotatably disposed on an axle (8) on the head for rotation about an axis (B) parallel with the axis (A). A counterbalance (4) is mounted on the head (1, 5, 16) opposite the chuck (6) on axle (8) comprising a weight (2) movable towards and away from the axis (A) and a roller (26) urged by a spring (24) against the outermost layer (28*a*) of the tape on reel (28) thereby detecting the diameter of tape carried by the reel (28) thus to move the weight (2) to a position to substantially counterbalance the reel as it rotates. A bundle of wires introduced into the mouths (1*a*, 3*a*) is taped by rotation of the head (1, 5, 16) to wrap the tape around the bundle of wires.

7 Claims, 3 Drawing Sheets

TAPING MACHINE FOR WIRE HARNESS

BACKGROUND OF THE INVENTION

The present invention relates to a taping machine and especially to taping machines suitable for use in applying tape to wire harnesses.

In various industrial applications it is necessary to connect various parts together using flexible connectors, for example electrical cables or flexible pipes, the connecting means being bundled together for a greater part of the connecting length for ease of positioning, etc. It is known to hold such bundles of wires or other flexible connecting members together by winding a suitable tape, for example plastics tape or textile tape carrying an adhesive coating, spirally round the bundles so that the turns of the tape overlap and form bundles of wires or flexible connectors. When taping wires together in this way, the end product is commonly referred to as a wiring harness. The bundles of wire can conveniently be supported by appropriately placed brackets or straps. This is especially important in the automobile industry (and also in the aircraft industry) where various wires originating for example at an instrument panel are grouped together and the bundle so collected threaded through the automobile (or aircraft) body to the various downstream end, for example control systems for the engine. For example, the wires may be connected to control switches on the instrument panel of a vehicle and the remote ends connected to control means for the vehicle or may be connected to instruments at the control panel, the remote ends being connected to appropriate parts of the vehicle. In either case signals are transmitted along the wires which in many cases may have to extend from front to rear of the vehicle, to various parts of the engine, doors, and the like. It is important to ensure that at all regions the various wires are properly grouped together and supported, for example adjacent the engine, so that they are not subject to unacceptable rubbing and/or wear and are properly protected against vibration and moisture by the tape wound around the bundle. As well as the protective function, the tape gives firmness and body to the harness and allows the assembly of harness configurations which are precisely adapted for convenient installation in an automobile.

Heretofore, the bundles have been taped manually or using an extremely heavy and cumbersome taping apparatus driven by belts or chains. It has therefore been a very slow and labour intensive operation, requiring considerable strength to make the bundles and make the wiring harnesses more rigid. The harnesses may for example be assembled on wiring looms or the like. The tapes may be plastic or metallic tapes or textile tapes, adhesive coated if necessary.

SUMMARY OF THE INVENTION

One of the various objects of the present invention is to provide an improved apparatus suitable for use in applying tape, for example to wire harnesses.

In accordance with the present invention, there is provided an improved apparatus suitable for use in applying tape to wire harnesses. The taping apparatus includes a body defining a first mouth opening to one side of the body and extending in an outward direction from a closed inner end, the body having an axis (A) generally perpendicular to said outward direction of the mouth and intersecting an inner end portion of the mouth and having at least two toothed gears mounted on the body for rotation about an axis.

A head comprising a support with a gear disposed around the head and in meshing engagement with said at least three gears, for rotation about said axis (A). The head defines a second mouth opening to one side of the head and extending in an outward direction from a closed inner end of the second mouth, an inner end portion of said second mouth being intersected by said axis (A) whereby the inner end portions of said first and second mouths are in register one with the other.

Mounting means is provided on the head for mounting a reel of tape on the head for rotation about an axis (B) parallel with the axis (A), the axis (B) disposed radially outwardly of the axis (A).

Drive means is provided to rotate said at least two gears in synchronism whereby to cause said gears to rotate said head about said axis (A).

Counterbalance means may also be mounted on the head substantially diametrically opposite the mounting means for the reel of tape. The counterbalance means may comprise a counterbalance weight mounted for movement in a direction generally towards and away from the axis (A) and control means for detecting the diameter of tape carried by a reel mounted on said mounting means and for moving the counterbalance weight to a position to substantially counterbalance said reel of tape.

In a preferred apparatus in accordance with the invention two gears mesh with the gear disposed around the head and are driven by a third gear in meshing engagement with both of the two first mentioned gears.

Preferably, the body of apparatus in accordance with the invention comprises a handle by which is mounted the drive means which conveniently comprises a motor adapted to rotate a gear for example a bevel gear, in meshing engagement with a further bevel gear adapted to drive said at least two gears and thus the gear around the head. Conveniently the handle is of elongated form and has a lengthwise axis extending substantially radially of the said axis of the body which extends generally perpendicularly to said outward direction of the mouth.

In a preferred apparatus in accordance with the invention comprising counterbalance means, the counterbalance means conveniently comprises a lever pivoted on the head and carrying the counterbalance weight at an end portion remote from the pivot and the control means suitably comprises a control rod pivotally connected to the lever intermediate the weight and pivot, and at the remote end has a portion for example a roller, of the rod, adapted in use to contact an outermost layer of tape wound on a reel mounted on the reel mounting means, and resilient means, e.g. a spring, urging the bowl portion firmly into contact with said outermost layer.

The motor of apparatus in accordance with the invention may be an electric motor, conveniently powered by a rechargeable battery also carried in the handle of the apparatus or may comprise a fluid power operated motor, for example a pneumatic motor mounted in the handle of the body.

In a preferred apparatus in accordance with the invention the apparatus comprises an operating trigger or switch which can be pressed by an operator to start the apparatus in a taping operation, the apparatus ceasing to operate on release of the switch (which trigger or switch also if desired may be adapted to control the speed of rotation of the head (dependent on the distance through which the trigger is moved by the operator)). Conveniently the apparatus comprises control means adapted to control rotation of the head and stop rotation only when said first and second mouths of the apparatus are in alignment; thus on release of the control switch, rotation of the head is monitored so that the appropriate stopping position is determined. This may conveniently be under the control of computer means, for example an associated microcomputer. Alternatively, apparatus in accordance with the invention may be programmed to rotate the tape around the wiring bundle a preselected number of times.

If the apparatus is manually held, it is progressively moved lengthwise of the wiring bundle by the operator so that as the taping head is rotated, the tape is wrapped round the wiring bundle in spiral fashion, an appropriate tension being applied to the tape if necessary. If desired, apparatus in accordance with the invention may comprise means adapted to heat stake an end portion of tape when it has been applied to a harness, thus to secure the end portion of the tape: this is especially convenient when using plastics tapes. Apparatus in accordance with the invention may, if desired comprise means for severing a tape at the end of an applying operation.

In a preferred apparatus in accordance with the invention an insert may be removably mounted in the second mouth whereby to adjust the dimension of the mouth opening for receiving harnesses of different dimensions. Conveniently apparatus in accordance with the invention comprises guide means for guiding tape as it is unwound from the reel.

In the preferred apparatus in accordance with the invention the use of a variable counterbalance weight is especially useful to compensate for the changing balance of the head as tape is unwound from a reel supported on the mounting means. As the tape is used from the reel, the counterbalancing weight progressively moves towards the axis of rotation of the head thus ensuring that the satisfactory balance of the head is retained thereby militating against unacceptable vibration of the apparatus. Vibration can lead to unsatisfactory taping operation, the taping being irregular and therefore unacceptable, as well as causing fatigue of an operator.

BRIEF DESCRIPTION OF THE DRAWINGS

There now follows a detailed description, to be read with reference to the accompanying drawings of apparatus, namely a taping machine embodying the invention. It will be realised that this machine has been selected for description to illustrate the invention by way of example.

In the accompanying drawings.

DESCRIPTION OF THE PREFERRED EMBODIMENT

Figure 1:
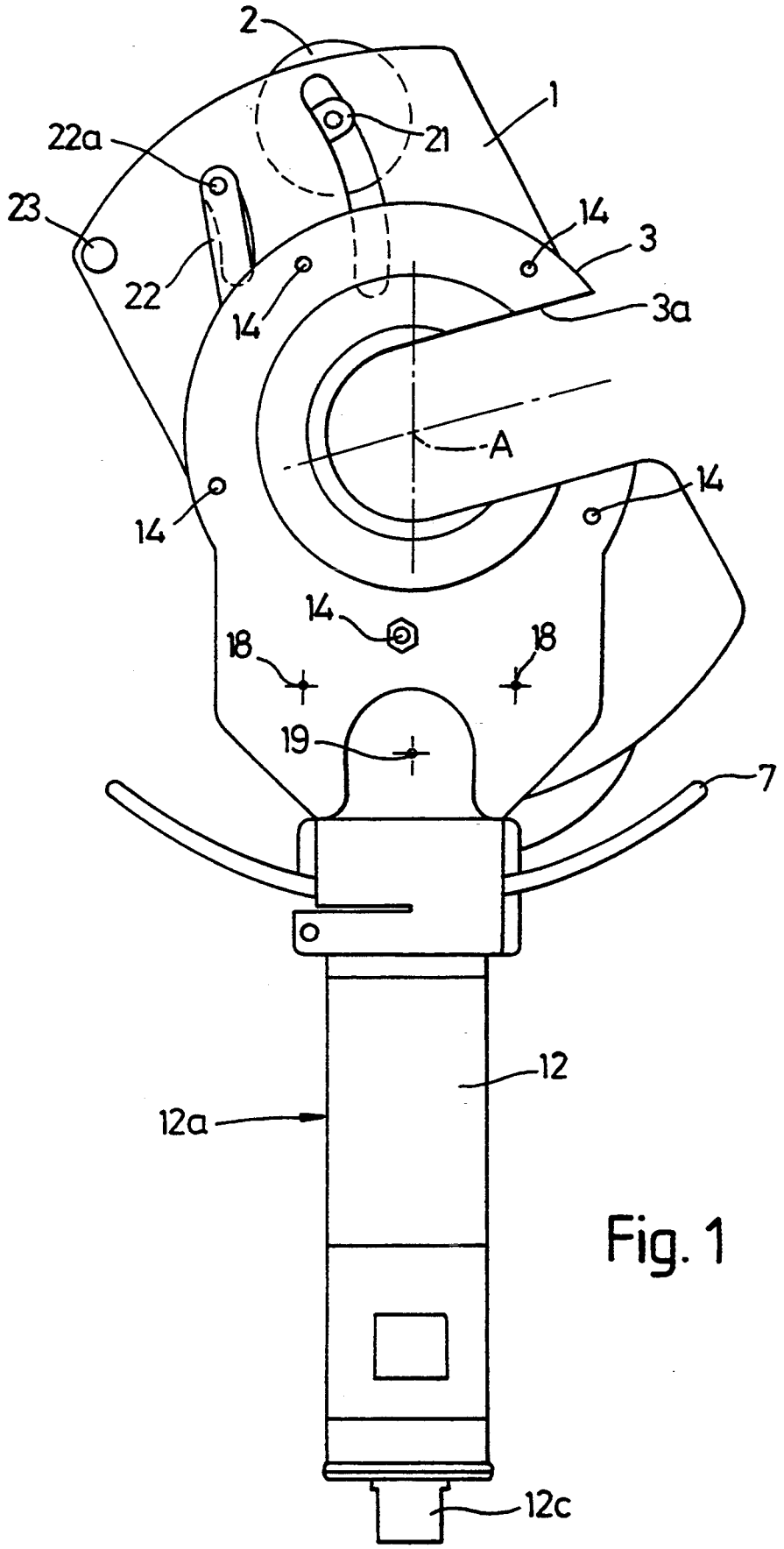
FIG. 1 is a front view of a taping machine embodying the invention.

The illustrative taping machine comprises a body (3) having a projecting handle (12*a*). The body (3) (see FIG. 1) defines a first mouth (3*a*) opening radially to one side of the body and extending in an outward direction from a closed inner end, the body (3) having an axis (A) generally perpendicular to said radial outward direction and extending transversely of the body (3), intersecting an inner end portion of the mouth. The closed inner end is approximately semi-circular in configuration, centered on the axis (A). The handle (12*a*) is of elongated, generally cylindrical form having a lengthwise axis (C) extending substantially radially of the axis (A). The handle (12*a*) comprises a pneumatic motor (12) and a connector (12*a*) for connecting the pneumatic motor (12) to a supply of compressed air. A trigger (12*b*) is provided on the handle (12*a*) for operating the apparatus. Two toothed gears (17) are mounted for rotation about axes (18), parallel with the axis (A), in the body. A head (1, 5, 16) is mounted for rotation on the body. The head comprises a support plate (1) secured to a gear member (5) which is conveniently of nylon, the gear member (5) having external gear teeth disposed around the outer periphery thereof and extending around the gear member from either side of a second mouth (1*a*) in the head so that there is a gap in the gear only at the mouth (1*a*). The gear member (5) is itself secured (at the opposite side to the mounting plate (1)) to a rotary mounting support (16) having a groove (16*a*) around its periphery. A plurality, namely five, of rollers (13) are mounted for rotation on axles (14) mounted in the body (3) disposed about the mouth (3*a*). The rollers (13) are positioned to run in the groove (16*a*) of the support (16), thus to mount the support (16) (and thus the remainder of the head, namely mounting plate (1) and gear member (5)) for rotation about the axis (A).

The second mouth (1*a*) in the head (1, 15, 16) likewise extends in an outward direction from a closed inner end of a second mouth (1*a*) and likewise being intersected by the axis (A) so that the inner end portions of the first and second mouths (3*a*, 1*a*) are in register with one another.

When the head (1, 15, 16) is mounted for rotation about the axis (A), the gears (17) are in meshing engagement with the gear on the outer periphery of the gear member (5). The positions at which the two gears (17) engage the gears of the gear member (5) are spaced apart circumferentially by a distance greater than the circumferential width of the mouth (1*a*). Thus as the head (1, 5, 16) rotates about the axis (A), at least one of the two gear members (17) remains in meshing engagement with the gear on the outer periphery of the gear member (5). A further gear (9) is mounted for rotation about an axle (19) parallel with the axis (A) in the body (3). Teeth of the gear (9) are in meshing engagement with the gears (17) so that the two gears (17) are rotated in synchronism by rotation of the gear (9). The gear (9) further comprises a bevel gear portion (9*a*) which is in engagement with a bevel gear (11) mounted for rotation about the axis (C) on an output shaft of the motor (12). Thus operation of the motor (12) to rotate the output shaft rotates the gear (11) and thus the gears (9) and (17) and through the gear (17), the head (1, 5, 16) about the axis (A).

Mounting means for mounting a reel (28) of tape are provided on the mounting plate (1) of the head. The mounting means comprise an axle (8) mounting for rotation a sprung fingered chuck (6) on which a tape reel can be retained by engagement between a back plate of the chuck and shoulders on spring fingers of the chuck (6). A reel (28) mounted on the mounting means (6, 8) is thus mounted for rotation about an axis (B) parallel with the axis (A), the axis (B) being disposed radially outwardly of the axis (A).

The use of the gear system described previously provides a compact and relatively lightweight drive means for the illustrative apparatus, the positioning of the two gears (17) being such that at least one remains in meshing engagement with the gears of the gear member (5) and the driving of the two gears (17) by a single gear (9) ensures that the gears remain in synchronism as the head (1, 5, 16) rotates. Use of such a compact drive means leads to a taping apparatus which is considerably lighter and less cumbersome than the known taping apparatuses discussed above.

The handlability of the illustrative apparatus is further improved by provision of counterbalance means (4) mounted on the mounting plate (1) of the head, substantially opposite the mounting means (6, 8) for the reel (28) of tape. Thus as the head rotates, the counterbalance means (4) provides a counterbalance for the weight of the reel of tape. The counterbalance means is so constructed and arranged as to automatically compensate for usage of tape from the tape reel (28). In order to provide this compensation, the counterbalance means (4) comprises a counterbalance weight (2) mounted for movement in a direction which is generally towards and away from the axis (A). The weight is in fact mounted on an end portion of a lever (21) mounted on a pivot (23) carried by the mounting plate (1), for arcuate movement about the pivot (23). The weight (2) is stabilised and guided by engagement of a guide peg in an arcuate slot (2*a*) of the mounting plate which is radial about the pivot (23). Control means of the counterbalance means comprises a rod (22) connected to the lever (21) by a pivot (22*a*) positioned intermediate the pivot (23) and the weight (2). A remote end portion of the rod (22) being guided by engagement of a peg in a slot (22*b*) of the mounting plate (1) extending radially of the axis (B) of the mounting means (6, 8). A roller (26) carried by an end portion of the rod (22) remote from the pivot (22*a*) is guided by the engagement of the peg in the slot (22*b*) for movement radially of the axis (B) towards and away from an outermost layer (28*a*) of tape wound on the reel (28) mounted on the mounting means (6, 8). A spring (24) extends between the lever (21) and an anchor point on the plate (1) to urge the roller (26) towards the axis (B). Thus the roller (26) is urged by the spring (24) against the outermost layer (28*a*) of tape wound on the reel (28). As the tape is used from the reel, the diameter of the reel progressively decreases and the roller (26) is moved by the spring (24) progressively toward the axis (B), so that the weight (2) is moved along the slot (2*a*) generally towards the axis (A). Thus as the weight of the tape reel (28) decreases, the weight (2) is moved closer to the axis of rotation (A) of the head so that the weight substantially balances the reel of tape. Without a counterbalance means, there would be a considerable out of balance load as the head rotates causing unacceptable vibration of the taping machine leading to operator fatigue and irregular and unacceptable taping. With the self-adjusting counterbalance means of the illustrative apparatus substantially equal loads are applied at opposite sides of the axis (A) so that there is no significant out of balance force and thus little or no vibration.

Thus the use of the counterbalance means as well as the compact drive means provided by the gearing system described above leads to a taping apparatus which is much lighter, less bulky and cumbersome, and generally more satisfactory in use than heretofore known taping apparatuses.

Whereas the illustrative apparatus comprises a pneumatic motor which must be connected to a suitable pneumatic air line, it will be appreciated that a hydraulic motor may be used or indeed an electric motor. If an electric motor is included instead of the pneumatic motor, this may be arranged to be powered by an internal power supply for example rechargeable batteries thus permitting such a taping apparatus to be used in a variety of situations without requiring connection to any external power source. This has not been possible with previously known taping systems, it is believed.

As can be seen from the drawings, the illustrative apparatus comprises a shield (7) which is disposed arcuately about the axis (A) positioned between the rotating head (1, 5, 16) and the handle (12*a*) to protect the operator against accidental contact with the rotating head which might cause injury.

In order to compensate for different sizes of wire bundles to be formed into a harness, the illustrative apparatus may be provided with an insert (29) which can be removably mounted in the mouth (1*a*). The insert (29) may conveniently be held in place by a spring loaded ball (not shown) carried in the head (1, 5, 16) and is selected so that a bundle of wires to be taped is snugly received in the inner end portion of the insert (29) so that the tape can readily be tightly wrapped about the bundle of wires. The insert (29) may be removed and exchanged for a one of appropriate size.

A tape guide roller (25) is mounted on the head (1) and guides the tape as it is pulled from the reel by rotation of the head about a bundle of wires received in the mouth (1*a*).

Figure 2:
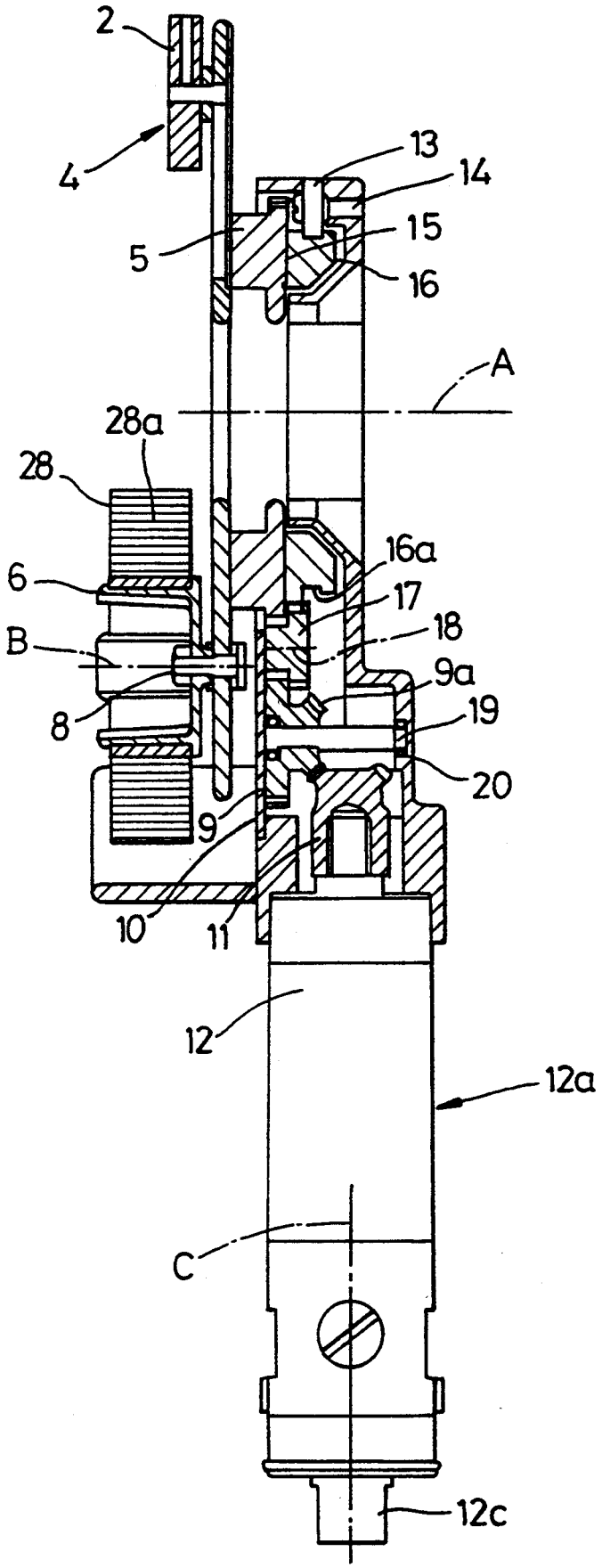
FIG. 2 is a view partly in section, of the illustrative taping machine.
Figure 3:
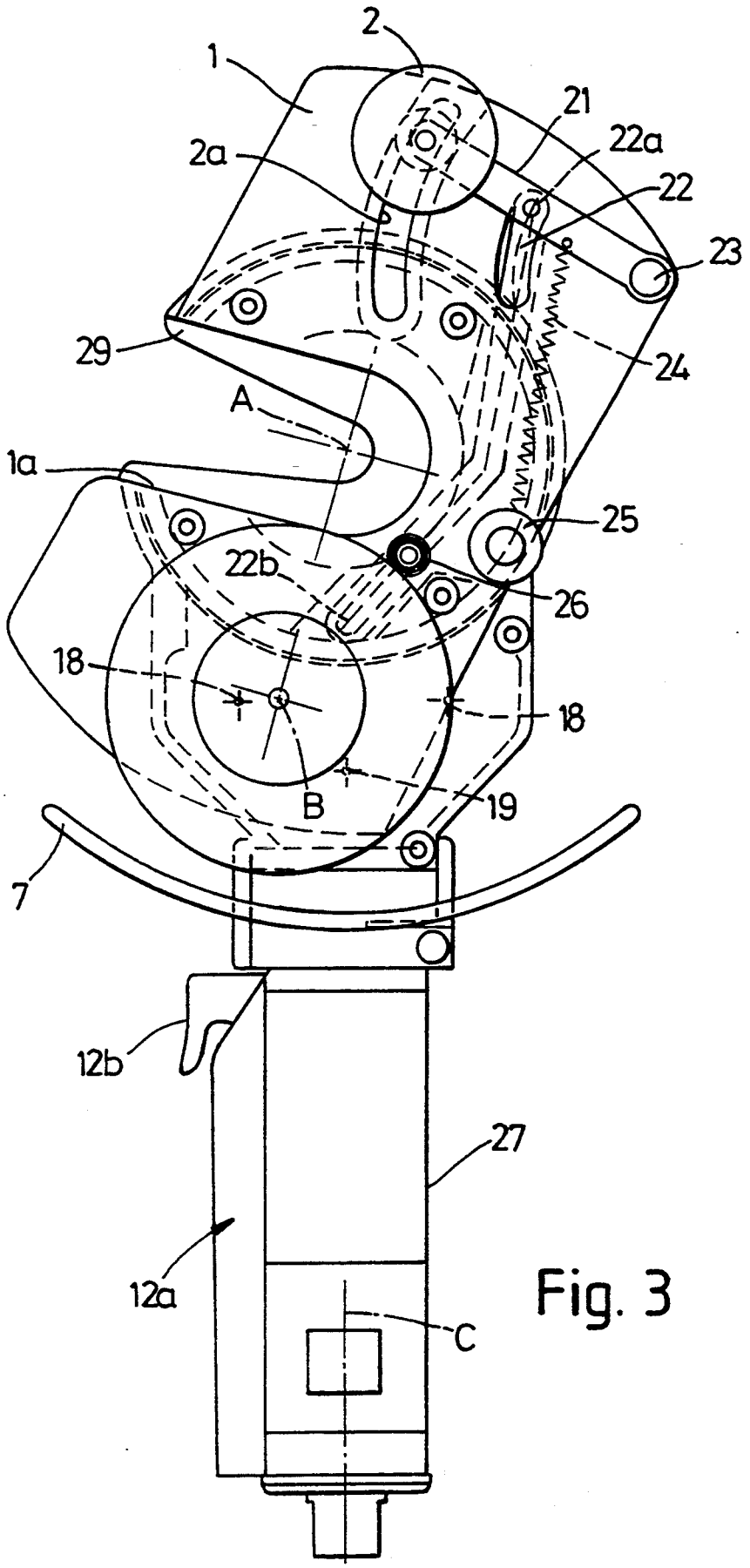
FIG. 3 is a rear view of the taping machine.

In order to introduce a bundle of wires to be taped into the mouth, it is of course necessary that the two mouths (1*a*, 3*a*) be in alignment with one another. To this end, means may be provided to ensure that rotation of the head is stopped only when the mouths (1*a*, 3*a*) are in satisfactory alignment. Alternatively, the positioning of the head in order to align the mouths (1*a*, 3*a*) may be adjusted manually by the operator after the trigger (12*b*) has been released to stop the head rotating. As can be seen from FIG. 2, the axles (18) and (19) extend between a part of the body (3) and a cover plate (10). The axle (19) is conveniently journaled for rotation in the roller bearings (20). Means can conveniently be provided to heat stake an end portion of the tape when it has been applied to a harness or to sever the tape at the end of an applying operation.

The taping apparatus is moved progressively along the bundle of wires to be taped, as the head rotates, thereby wrapping the tape in a helical fashion around the bundle of wires sufficiently tightly to retain the bundle in a firm and easily handled manner. If desired, the taping apparatus may be mounted on a guide track, the bundle of wires being positioned generally parallel to the guide track and the taping apparatus slid along the guide track thus to likewise wrap tape around the bundle of wires in a helical fashion.

It is claimed:

1. Apparatus for applying tape to wire harnesses comprising:

a body (3) defining a first mouth (3*a*) opening to one side of the body (3) and extending in an outward direction from a closed inner end, the body (3) having an axis (A) generally perpendicular to said outward direction of the mouth (3*a*) and intersecting an inner end portion of the mouth;

at least two toothed gears (17) mounted on the body (3) each for rotation about a respective axis (18);

a head (1, 5, 16) comprising a support (5) with a gear disposed around the support and in meshing engagement with said at least two gears (17), the head (1, 5, 16) being supported for rotation about said axis (A), the head (1, 5, 16) defining a second mouth (1*a*) opening to one side of the head (1, 15, 16) and extending in an outward direction from a closed inner end of the second mouth (1*a*), an inner end portion of said second mouth (1*a*) being intersected by said axis (A) whereby the inner end portions of said first and second mouths (1*a*, 3*a*) are in register one with the other;

mounting means (6, 8) on the head (1, 5, 16) for mounting a reel (28) of tape on the head for rotation about an axis (B) parallel with the axis (A), the axis (B) disposed radially outwardly of the axis (A);

drive means (9, 11, 12) adapted to rotate said at least two gears (17) in synchronism whereby to cause said gears (17) to rotate said head about said axis (A), and counterbalance means (4) mounted on the head (1, 5, 16) substantially diametrically opposite the mounting means (6, 8) for the reel (28) of tape, said counterbalance means (4) comprising counterbalance weight (2) mounted for movement in a direction generally towards and away from the axis (A) and control means (21, 22, 24, 26) for detecting the diameter of tape carried by a reel (28) mounted on said mounting means (6, 8) and for moving the counterbalance weight (2) to a position to substantially counterbalance said reel (28) of tape.

2. Apparatus according to claim 1 wherein said at least two gears (17) comprises only two gears (17) and wherein the drive means comprises a gear (9) rotatable about an axis (19) in meshing engagement with both of the gears (17).

3. Apparatus according to claim 2 wherein the body (3) comprises a handle (12*a*) which mounts said drive means (9, 11, 12) comprising a motor (12) adapted to rotate a gear (11) in meshing engagement with said gear (9).

4. Apparatus according to claim 1 wherein the body (3) comprises a handle (12*a*) which mounts said drive means 9, 11, 12), the handle (12*a*) being of elongated form and having a lengthwise axis (C) extending substantially radially of the axis (A).

5. Apparatus for applying tape to wire harnesses comprising:

a body (3) defining a first mouth (3*a*) opening to one side of the body (3) and extending in an outward direction from a closed inner end, the body (3) having an axis (A) generally perpendicular to said outward direction of the mouth (3*a*) and intersecting an inner end portion of the mouth (3*a*);

a head (1, 5, 16) mounted on the body (3) for rotation about said axis (A), the head (1) defining a second mouth (1*a*) opening to one side of the head (1, 5, 16) and extending in an outward direction from a closed inner end of the second mouth (1*a*), an inner end portion of said second mouth (1*a*) being intersected by said axis (A) whereby the inner end portions of said first and second mouths are in register one with the other;

drive means (9, 11, 12) adapted to rotate said head;

mounting means (6, 8) on the head for mounting a reel (28) of tape on the head for rotation about an axis (B) parallel with the axis (A), the axis (B) disposed radially outwardly of the axis (A); and counterbalance means (4) mounted on the head substantially diametrically opposite the mounting means (6, 8) for the reel of tape, said counterbalance means (4) comprising a counterbalance weight (2) mounted for movement in a direction generally towards and away from the axis (A) and control means (21, 22, 24, 26) for detecting the diameter of tape carried by a reel (28) mounted on said mounting means (6, 8) and for moving the counterbalance weight (2) to a position to substantially counterbalance said reel (28) of tape.

6. Apparatus according to either claim 1 or claim 5 wherein the body (3) comprises a handle (12*a*) by which is mounted the drive means (9, 11, 12).

7. Apparatus according to either claim 1 or claim 5 wherein said counterbalance means (4) comprises a lever (21) pivotally mounted on the head (1, 5, 16) and carrying the counterbalance weight (2) at an end portion remote from the pivot (23), and said control means comprises a rod (22) pivotally connected to the lever (21) intermediate the weight (2) and pivot (23), means (22*b*) guiding a portion (26) of the rod (22) in use to contact an outermost layer (28*a*) of tape wound on a reel (28) mounted on the mounting means and resilient means (24) urging the portion (26) firmly into contact with said layer (28*a*).

* * * * *